US005613622A

United States Patent [19]

Surrena et al.

[11] Patent Number: 5,613,622

[45] Date of Patent: Mar. 25, 1997

[54] TANK HAVING AN INNER BLADDER

[75] Inventors: Braden J. Surrena, Marietta, Ga.; Kenneth D. Peters, Houston, Tex.

[73] Assignee: ISK Biosciences Corporation, Mentor, Ohio

[21] Appl. No.: 490,079

[22] Filed: Jun. 13, 1995

[51] Int. Cl.[6] ..... B65D 35/22

[52] U.S. Cl. ..... 222/105; 222/143; 222/183; 222/185.1; 222/386.5; 220/403; 220/4.12

[58] Field of Search ..... 222/105, 183, 222/143, 185.1, 386.5; 220/403, 400, 693, 4.17, 4.12

[56] References Cited

U.S. PATENT DOCUMENTS

| | | | |
|---|---|---|---|
| 2,758,747 | 8/1956 | Stevens | 220/449 |
| 3,559,849 | 2/1971 | Ancel | 222/143 |
| 3,756,367 | 9/1973 | Mitchell et al. | 222/386.5 X |
| 4,421,253 | 12/1983 | Croley | 222/105 |
| 4,635,814 | 1/1987 | Jones | 220/403 |
| 4,996,760 | 3/1991 | Coleman | 222/105 X |
| 5,067,636 | 11/1991 | Pfeiffer et al. | 222/105 X |
| 5,203,470 | 4/1993 | Brown | 220/462 |
| 5,356,029 | 10/1994 | Hogan | 222/183 X |
| 5,375,741 | 12/1994 | Harris | 222/185.1 X |

FOREIGN PATENT DOCUMENTS 0358053 3/1990 European Pat. Off. .

OTHER PUBLICATIONS

"Collapsible Container . . . ", *Packaging Technology & Eng.*, Apr., 1994, p. 17.

"Tuscarora: Promoting . . . ", *Good Packaging Mag.*, Apr., 1994, pp. 14, 15, and 18.

"Bioscience Firm . . . ", *Packaging*, Apr. 1994, p. 27.

*Primary Examiner*—Kevin P. Shaver

*Attorney, Agent, or Firm*—Thompson Hine & Flory LLP

[57] ABSTRACT

A container for containing flowable material comprises a rigid tank having a top opening therein for filling the tank with flowable material. A bottom opening in the lowermost portion of the tank for evacuating the flowable material. A cap seals the top opening in the tank and a piping assembly is connected to the bottom opening. A collapsible bladder inside the tank prevents the flowable material from coming into contact with the tank. A mating top cover and bottom base assembly are shaped to receive and enclose the tank. The piping assembly includes a dispensing spout which utilizes a spout, a dry-lock or a spring valve.

10 Claims, 2 Drawing Sheets

TANK HAVING AN INNER BLADDER

BACKGROUND OF THE INVENTION

The present invention relates to an apparatus for containing and dispensing flowable materials, such as for irrigation systems. More particularly, this invention relates to an tank having a sturdy, collapsible, bladder lining the inside of the tank to prevent scaling.

It is known that a good way to transport and store flowable materials is in tanks. This is especially useful for example, in situations when liquid chemicals, such as pesticides, must be transported to a users home or farm.

Mini bulk tanks used in the industry having a capacity of 50–250 gallons (189.4–947.0 liters) are well suited for solutions and emulsifiable liquids but are not generally adaptable to suspension concentrates or flowable formulations, such as chlorothalonil. This is due to a scale which inherently forms within the inner walls of the tanks upon contact with air due to oxidation. The chemical then forms cakes of chemical waste which cannot be used. The viscous liquid clings to the sides of the tank and crusts of scale particles develop which then flake off of the tank. Due to the formation of these scale flakes, the nozzle and screen in the tank dispenser become narrowed which eventually leads to complete nozzle and screen blockage. Therefore, the tank must be cleaned out often or discarded. Thus the tanks do not lend themselves to returnability. Discarded tanks, containing residues of possibly toxic chemicals must be disposed of in special hazardous waste disposal sites and are hazardous to the environment. In addition, the tanks, even if cleaned, cannot be reused for different chemicals due to the possible chemical interaction between any remaining residues of the previous chemical on the walls of the tank and the newly inserted chemical.

Also, the users have a limited amount of space in which to store the materials and the empty containers after they have completed their chemical treatments.

In conventional tanks, plastic linings were melted onto the interior walls of the tank or blow-molded free standing plastic liners were placed inside the tank during its assembly. However, the melted linings were not sturdy and the tanks could not be reused. The blow-molded tanks tended to be expensive and could not be removed from the tank to be cleaned. Also, for gravity flow of the tanks they must be elevated. Therefore, they must be placed on loading docks or trucks, or pedestals had to be built underneath the tanks provide elevation of the tank to remove its contents and fill a measuring device or other suitable container.

For certain tenacious chemicals, such as those used to protect plants from the elements by sticking to the leaves, the evacuation of the tank is difficult due in part to their viscous nature. Therefore, pumps are conventionally used to aid in evacuation of the tank. However, pumps are not reliable and tend to fail thereby wasting time and effort or the users.

Therefore, it is an object of the present invention to provide an apparatus which provides minimal contact of the product with the air over long periods; to provide an apparatus which uses an inner lining or bladder; to provide an apparatus that eliminates the formation of scale and subsequent plugging of the nozzle; an apparatus which can be reused; an apparatus which can be contained and stacked; and an apparatus which is cost efficient and relatively easy to maintain. This object is accomplished by the use of a non-scaling, self-supporting, rigid outer tank fitted with a heavy, durable collapsible bladder. The tank is held in a base and has a cover. In addition, because it is a gravity flow tank, no pump is needed to evacuate the enclosed flowable material.

SUMMARY

In accordance with the present invention, a container for containing flowable material is provided which comprises a rigid tank having a top opening in the tank for filling the tank with the flowable material; a bottom opening in a lowermost portion of the tank for evacuating the flowable material; an effluent piping assembly connected to the bottom opening in the tank; a cap to seal the top opening; and a collapsible bladder inside the tank which prevents the flowable material from coming in contact with the tank material, and top cover and bottom base assemblies which are shaped to receive the tank. The pipe has a dispensing end which utilizes a spout, a dry-lock, or a spring valve.

BRIEF DESCRIPTION OF THE DRAWINGS

The invention will now be described by way of example and with reference to the accompanying drawings, in which.

DETAILED DESCRIPTION OF THE PREFERRED EMBODIMENT

In a typical embodiment of the present invention, a non-scaling tank for flowable materials such as pesticide flowable formulations or suspension concentrates consists of a rigid self-supporting outer tank fitted with a heavy, durable collapsible bladder. The flowable formulation is pumped into the bladder within the 50 to 250 gallon "mini bulk" tank for transport and then used for product additions to the farmer's spray tank or other similar use. The bladder has a two-fold purpose. It keeps air from contacting the product and the product from contacting the tank, thereby preventing scale formation and contamination of the tank walls. In this manner, the tank and the bladder are both refillable and reusable. The bladder may be reused six or more times and then removed at the end of a season and replaced for use in the next year. Thus, the tank is not contaminated and does not need to be discarded. Therefore a significant amount of hazardous chemical waste is reduced.

As a further advantage of the present invention, the tank can be mounted within a base and covered with a top cover assembly to provide support and ease in stackability of spherical or elliptical tanks.

This system will now be described in detail below with respect to the figure. It is to be understood that the forgoing general description and the following detailed description are exemplary and explanatory but are not to be restrictive of the invention. The accompanying drawings which are incorporated in and constitute a part of this invention, illustrate the embodiments of the invention, and, together with the description, serve to explain the principles of the invention in general terms. Like numerals refer to like parts throughout the disclosure.

The outer tank 10 is generally spherical or elliptical, is rigid and is made of either metal or hard plastic, preferably HDPE (high density polyethylene). The bladder 12 is preferably a removable, internal, flexible polymer plastic bag. A preferred bladder is formed of 2 plies of 10 mil polyethylene. This bladder is especially useful in containing viscous chlorothalonil which is conventionally dispensed by a pump.

Figure 1:
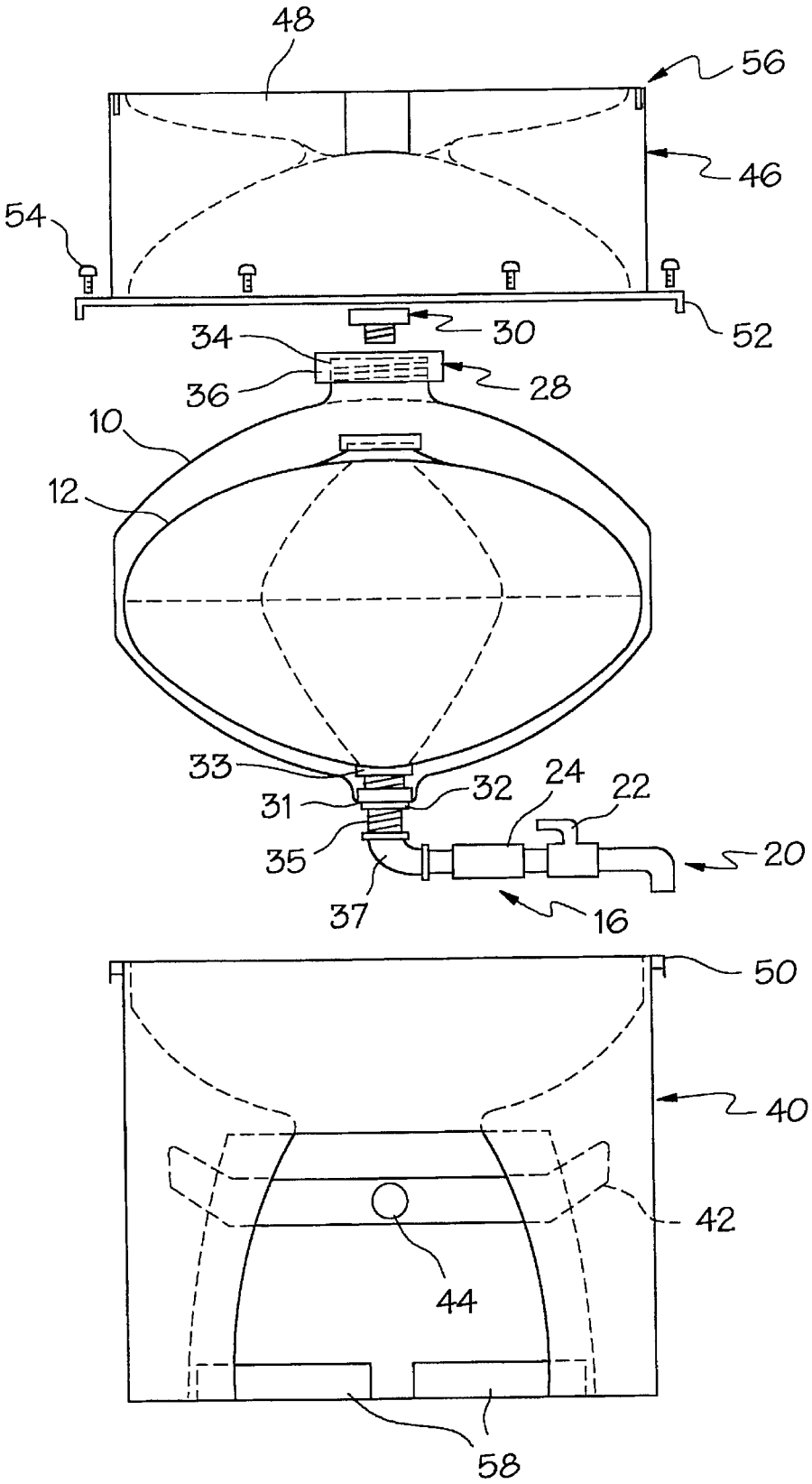
FIG. 1 is a container and base in accordance with the present invention.
Figure 2:
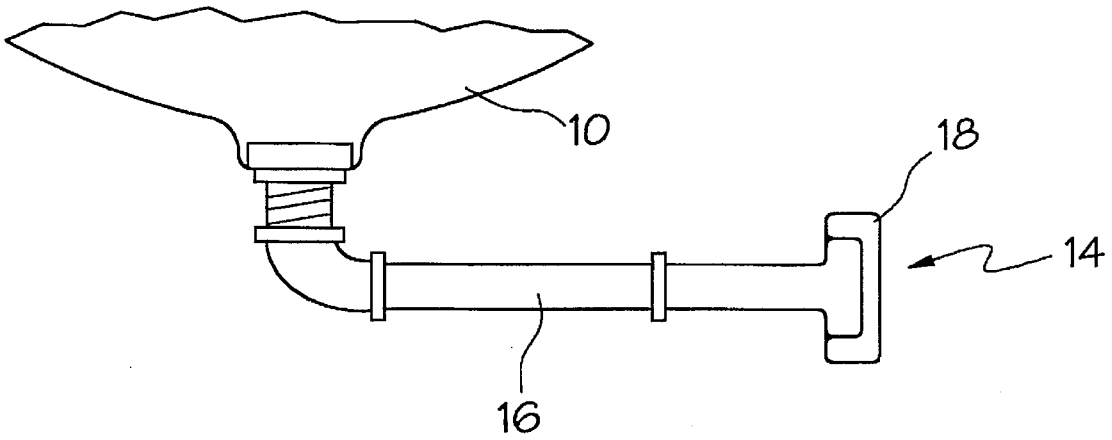
FIG. 2 is an optional piping assembly for the container of FIG. 1.

The tank 10 is in fluid communication at its lowermost point with an effluent pipe assembly 16 which has a dispensing end which allows the contents to be dispensed from the bladder 12. Several optional fittings can be used on the dispensing end of the pipe based upon the user's needs. If a gravity feed is desired, a spout such as 20 can be used. If the user wants to hook the tank to a pump or meter, a dry lock 14 can be used, as shown in FIG. 2. A dry lock uses a spring valve so that when the fitting is snapped onto the pipe, no product will dribble out the end. A third optional fitting is a cam lock quick connect.

As a further alternative, the pipe assembly may extend in two directions from the base of the tank utilizing different fittings.

The spout fitting 20 is threaded by any one of several interchangeable standard 1.5 inch NPT (national pipe thread) pipe connections. The assembly 16 is threaded into the lowermost portion of the bladder 12 through the tank to allow for gravity to drain the fluid into the spout. A 90° L-shaped spout can be used for gravity pouring into a bucket or similar container. Or a cam-lock quick connection can be used for hook-up directly to a pump. In addition, a standard nipple can be used to install a meter.

The dry lock 14 shown in FIG. 2, if used, preferably includes a tamper evident seal 18 as is known in the art, so that the user can determine whether the enclosed chemicals have been tampered with and as a result, be assured no foreign substances have been associated with the chemical.

The tank 10 has a bottom opening 31 which includes a liquid tight gasket flange 32 sealed about the opening. This flange 32 is threaded for the attachment of the piping assembly. Further, the bladder includes a female fitting on the bottommost portion and a 2 inch NPT fitting 33 is heat sealed to the opening so as to prevent leakage. The fitting 33 is also threaded for attachment of the piping assembly 16. An externally threaded 2 inch pipe nipple 35 passes through the tank flange 32 and extends into the heat sealed fitting 33 on the bladder. The nipple 35 is then flange threaded onto a 90° elbow 37 on the pipe assembly 16. A ball valve 22 is used to open and close the spout 20 and a one way valve 24 ensures that overflow does not back up into the tank 10.

The present invention also employs a unique dual lid arrangement. A first cap 26 is provided on the top of the bladder preferably in the form of a 2 inch (5.1 cm) NPT fitting with a plug heat sealed to the bladder and a tamper evident cap. An aperture 34 is provided in the top portion of the tank 10. A second cap 28 is provided on a screw-threaded neck 36 on the tank itself to cover the top tank aperture 34 and is preferably a 6 inch (15.3 cm) diameter polypropylene cap. As part of this second cap 28, a screw turn air vent 30 of preferably ¾ inch (1.9 cm) is provided to inflate the bladder 12 within the tank 10. The vent 30 is screwed down during shipping of the tank in order to provide a well-sealed container.

To fill the bladder 12, the bladder is pulled up to the aperture 34, the first cap 26 is removed and the bladder is filled with the desired fluid. A flexible 2 inch NPT fitting connected to a screw threaded bung fitting may be used to help fill the tank. Typically, a relatively large aperture 34 is provided in the top of the tank in order to increase the accessibility to the bladder 12. The empty bladder must be of a size to fit through this hole 34 in order to be removed from the tank 10 for cleaning or replacement.

The tank further includes a base 40 which supports the tank above ground level so that the liquid contained in the tank can be evacuated without the use of a pump. The base however, is mounted high enough so that the user is able to put a container or measurement device under the outlet on the ground. This base 40 is shaped to receive the bottom portion of the tank including the attached piping assembly 16. The base further includes a cross-strap 42 to support the pipe assembly 16. This strap is, for example, 3–4 inches wide by 17–18 inches long and spans a gap in the base. This belt 42 is bolted or molded into place. The pipe 16 with associated spout 20 extends through an opening 44 in the base for easy access.

Similarly, the top of the tank 10 is fitted with a top cover assembly 46 shaped to receive the top portion of the tank and secure the tank in the base. The top cover assembly 46 includes a rain channel 48 which opens on all four sides of the top cover assembly to prevent water from accumulating on the tank. Further, there is a flange 50 on the top edge of the base and a flange 52 on the bottom edge of the top cover. A plurality of self-tapping bolts 54 are used to secure the top cover 46 to the base 46. Typically 8 bolts 54 are used. Together with the base, the top forms a system wherein several spherical tanks may be easily stacked and access is provided to all of their corresponding spouts through openings 44. Therefore, the base assembly 40 has a dual role as a stand and to provide stackability. The top assembly and the base are generally rectangular and are typically made of a rigid HDPE.

In addition, the top assembly 46 includes tie down notches 56. Typically four of these are provided, one at each corner. The tie down notches 56 allow a handler to run strapping (not shown) over the top of the tanks and base assemblies to provide support so that the tanks do not fall when being transported.

The stackable members 40, 46 are also useful in packaging and storing. In addition, the storage system typically includes lift truck pallet access channels 58 at the bottom of the base assembly 40 for transfer by fork lifts and the like.

As an alternate embodiment to the present invention, the tank 10 may be pressurized with gas, instead of relying on gravity flow. This allows the tank to be at ground level and be evacuated to a mixing area having a higher elevation. In this manner, the level of the tank does not interfere with the evacuation of the tank and the pressure keeps air out of the tank which decreases the formation of scale and urges the inner bag or bladder into contact with the interior walls of the tank. In this embodiment, a steel plate having both an air valve and a pressure release valve replace the cap 28. The tank can be pressurized up to about 12–13 psi. The pressure can then be reduced by the pressure release on the plate on top of the tank. In this embodiment of the present invention, the tank does not depend on gravity feed.

Therefore, in accordance with the present invention, hazardous waste disposal is reduced by increasing the number of times each tank may be used, scaling is reduced and spherical or elliptical tanks are provided which can easily be stacked.

In accordance with the present invention, any chemical which is compatible with the high density polyethylene plastic that comprises the bladder could be used without departing from the scope of the claims.

Having described the invention in detail and by reference to preferred embodiments thereof, it will be apparent that modifications and variations are possible without departing from the scope of the invention defined in the appended claims.

What is claimed is:

1. A container for containing flowable material comprising:

a rigid tank;

a top tank opening in the uppermost portion of said tank;

a cap for sealing said top tank opening;

a bottom tank opening in a lowermost portion of said tank;

an effluent piping assembly having a first end and an inlet for receiving flowable material, said inlet passing through said bottom tank opening;

a collapsible bladder inside said tank which prevents said flowable material from coming in contact with said tank;

a top bladder opening in the uppermost portion of said bladder;

a cap to seal said top bladder opening;

a bottom bladder opening in a lowermost portion of said bladder in fluid communication with said inlet, said bottom bladder opening being sealed to said bottom tank opening; and top and bottom base assemblies which are shaped internally to receive said tank.

2. The container of claim 1 wherein said tank is generally spherical or elliptical.

3. The container of claim 1 wherein said second cap includes a vent for pressurizing said bladder.

4. The container of claim 1 wherein said top assembly includes tie down notches.

5. The container of claim 1 wherein said base assembly includes cutouts for lifting of said container using a fork lift.

6. The container of claim 1 wherein said flowable material is chlorothalonil.

7. The container of claim 1 wherein said piping assembly includes a spout, a dry lock, a cam lock quick connect, or a combination thereof.

8. The container of claim 3 wherein said cap for said top tank opening includes an air valve and a pressure release valve.

9. The container of claim 1 wherein said bottom base assembly includes a support strap for said tank.

10. The container of claim 1 wherein said top assembly includes a rain channel.

* * * * *